US011413676B2

(12) United States Patent
Chen et al.

(10) Patent No.: US 11,413,676 B2
(45) Date of Patent: Aug. 16, 2022

(54) ELECTROMAGNETIC STAMPING APPARATUS

(71) Applicant: National Taiwan Normal University, Taipei (TW)

(72) Inventors: Shun-Tong Chen, Taipei (TW); Chao-Rong Chiang, Taipei (TW); Chien-Ta Huang, Taipei (TW)

(73) Assignee: NATIONAL TAIWAN NORMAL UNIVERSITY, Taipei (TW)

( * ) Notice: Subject to any disclaimer, the term of this patent is extended or adjusted under 35 U.S.C. 154(b) by 314 days.

(21) Appl. No.: 16/746,516

(22) Filed: Jan. 17, 2020

(65) Prior Publication Data

US 2021/0146422 A1 May 20, 2021

(30) Foreign Application Priority Data

Nov. 20, 2019 (TW) ..... 108142198

(51) Int. Cl.

| | |
|---|---|
| ***B21D 26/14*** | (2006.01) |
| ***B24B 41/02*** | (2006.01) |
| ***B30B 1/42*** | (2006.01) |
| ***B21D 22/02*** | (2006.01) |

(52) U.S. Cl.

CPC ..... *B21D 26/14* (2013.01); *B21D 22/02* (2013.01); *B24B 41/02* (2013.01); *B30B 1/42* (2013.01)

(58) Field of Classification Search

CPC ..... B30B 1/42; B21D 22/02; B21D 22/06; B21D 26/14; B21J 15/26; B21J 15/24; B25D 11/062; B24B 41/02; Y10T 29/49803; Y10T 83/8765; B26D 5/086

USPC ..... 72/430

See application file for complete search history.

(56) References Cited

U.S. PATENT DOCUMENTS

| | | | | |
|---|---|---|---|---|
| 5,233,895 | A * | 8/1993 | Coneski | B26D 5/08 83/575 |
| 7,823,434 | B2 | 11/2010 | Lee et al. | |
| 9,027,220 | B2 * | 5/2015 | Schlafhauser | B21J 15/025 29/432 |
| 9,421,598 | B2 | 8/2016 | Baud et al. | |

(Continued)

FOREIGN PATENT DOCUMENTS

| | | |
|---|---|---|
| CN | 2625070 Y | 7/2004 |
| CN | 201 049379 Y | 4/2008 |

(Continued)

*Primary Examiner* — Edward T Tolan

(57) ABSTRACT

An electromagnetic stamping apparatus includes a work platform configured to load a work piece. A stamping component is coupled to the work platform and has a first position and a second position. The stamping component includes a stamping rod and a stamping head. The stamping head stamps the work piece on the first position. An electromagnetic device is coupled to the stamping rod and generates a magnetic force according to an alternating current to push the stamping component to the first position to make the stamping component stamp the work piece. A compression spring pushes the stamping component to the second position according to the restoring force of the compression spring. Wherein, the magnetic force is greater than the restoring force of the compression spring to make the stamping component stamp the work piece twice in every waveform period of the alternating current.

9 Claims, 6 Drawing Sheets

(56) References Cited

U.S. PATENT DOCUMENTS

| | | | | |
|---|---|---|---|---|
| 2001/0006016 | A1* | 7/2001 | Henderson | G05B 19/44 83/13 |
| 2011/0296969 | A1* | 12/2011 | Lenzotti | B21D 28/246 83/563 |
| 2021/0031256 | A1* | 2/2021 | Suzuki | B21D 37/10 |

FOREIGN PATENT DOCUMENTS

| | | | | | |
|---|---|---|---|---|---|
| CN | 201049379 | Y | * | 4/2008 | |
| CN | 101262163 | A | * | 9/2008 | |
| CN | 101262163 | A | | 9/2008 | |
| CN | 107309313 | A | * | 11/2017 | |
| WO | WO-2019076628 | A1 | * | 4/2019 | B30B 15/32 |

* cited by examiner

ELECTROMAGNETIC STAMPING APPARATUS

BACKGROUND OF THE INVENTION

1. Field of the Invention

The present invention relates to an electromagnetic stamping apparatus, especially to an electromagnetic stamping apparatus which can stamp the work pieces rapidly by electromagnetic driving to improve production efficiency.

2. Description of the Prior Art

Nowadays, the products are becoming miniaturized and automated, so that the requirements for precision of products and production efficiency are also increasing. Furthermore, the microstructure manufacturing process of products and parts also needs to reach the high precision level. Nowadays, the microstructures produced by stamping apparatus have been widely applied to various fields (such as optoelectronic fields, aerospace fields and biomedical fields).

In the optoelectronic industries, the microstructures can be applied to the light guide plates of OLEDs and the mobile phone screens to improve the uniformity and the image correction. In the aerospace industries, the microstructures can be applied to the surface of aircraft shells to prevent the aircrafts from being frozen in low temperature environments to cause accidents. In the biomedical industries, the microstructures can be used as miniature containers for biological cell culture. In addition, the microstructures can make the surface of the material has a resistibility to adhesion and corrosion, and can also be widely applied to ships, military equipments, power and communications.

In order to achieve high-precision and miniaturized microstructures, it is necessary to stamp the work piece point by point by a micro stamping device with a hardened tool. Since the microstructures are the high-density structures, it would take a long time to manufacture and need to modify the stamping path continuously to achieve high-precision microstructures. In addition, after stamping the work piece for a long time, the stamping tool may be sticky and then the stamping efficiency may decrease, thereby reducing the quality of products and increasing production costs.

Thus, it is necessary to develop a new stamping apparatus which can effectively improve the production efficiency and reduce the production costs to solve the problems of the prior art.

SUMMARY OF THE INVENTION

Therefore, the present invention provides an electromagnetic stamping apparatus can stamp work pieces rapidly and online grind the stamping component by electromagnetic driving to improve production efficiency.

According to an embodiment of the present invention, the electromagnetic stamping apparatus includes a work platform, a stamping component, an electromagnetic device and a compression spring. The work platform is configured to load a work piece. The stamping component is configured relative to the work platform and has a first position and a second position. The stamping component includes a stamping rod and a stamping head. The stamping head is disposed at one end of the stamping rod and configured for stamping the work piece at the first position. The electromagnetic device is coupled to the stamping rod of the stamping component. The electromagnetic device generates the magnetic force according to an alternating current to push the stamping component to the first position to make the stamping component stamp the work piece. The compression spring is coupled to the stamping component. The compression spring pushes the stamping component to the second position by the restoring force of the compression spring. Wherein, the magnetic force is greater than the restoring force of the compression spring to make the stamping component stamp the work piece twice in every waveform period of the alternating current.

Wherein, every waveform period of the alternating current has a first peak value area, a second peak value area and a base value area between the first peak value area and the second peak value area. The electromagnetic device respectively generates a first magnetic force and a second magnetic force according to the first peak value area and the second peak value area to push the stamping component to the first position. The stamping component is pushed to the second position by the compression spring in the base value area.

Moreover, the waveform of the alternating current is a sine wave.

Wherein, the electromagnetic device further includes an electromagnetic component and an electromagnetic coil. The electromagnetic component is coupled to the stamping rod of the stamping component and magnetically coupled to the electromagnetic coil. The electromagnetic coil generates the magnetic force according to the alternating current applied to the electromagnetic coil to attract the electromagnetic component to make the electromagnetic component push the stamping component to the first position.

Wherein, the electromagnetic stamping apparatus further includes a limit block coupled to the stamping component, and the stamping component further includes a block coupled to the stamping rod. The compression spring is disposed between the limit block and the block, and two ends of the compression spring respectively contact the limit block and block. The compression spring pushes the block according to the restoring force of the compression spring to push the stamping component to the second position.

Wherein, the electromagnetic stamping apparatus further includes a rotating component. The rotating component includes a motor and a timing belt. The timing belt is coupled to the stamping rod and the motor, and the motor drives the stamping component to rotate at a rotational speed.

Moreover, the electromagnetic stamping apparatus further includes a limit component, and the limit component includes a limit groove. The limit groove is coupled to the stamping component and configured to limit the motion direction of the stamping component. The stamping rod contacts the limit groove by the tensile force of the timing belt.

Wherein, the electromagnetic stamping apparatus further includes a sensor and a controller. The sensor is coupled to the stamping component and the controller is connected to the sensor and the motor. The sensor is configured for sensing the motion state of the stamping component and generate a sensing value, and the controller controls the motor to rotate at the rotational speed according to the sensing value.

Furthermore, the electromagnetic stamping apparatus includes a grinding mechanism movably contacted the stamping component. The grinding mechanism includes a grinding wheel and the controller is connected to the grinding mechanism. The controller controls the grinding mechanism to make the grinding wheel of the grinding mechanism contact and grind the stamping head of the stamping component when the stamping component rotates at the rotational speed.

Wherein, the stamping head includes a stamping portion and a flat portion on the outer edge of the stamping portion. The stamping portion stamps the work piece and the flat portion contacts the surface of the work piece when the stamping head stamps the work piece.

In summary, the electromagnetic stamping apparatus of the present invention can control the stamping component to stamp the work piece twice in every waveform period of the alternating current by the electromagnetic device and the compression spring, and control the stamping direction of the stamping component by the rotating component and the limit component. Moreover, the electromagnetic stamping apparatus also can online grind the stamping head to improve the production efficiency and reduce the production costs.

BRIEF DESCRIPTION OF THE APPENDED DRAWINGS

DETAILED DESCRIPTION OF THE INVENTION

For the sake of the advantages, spirits and features of the present invention can be understood more easily and clearly, the detailed descriptions and discussions will be made later by way of the embodiments and with reference of the diagrams. It is worth noting that these embodiments are merely representative embodiments of the present invention, wherein the specific methods, devices, conditions, materials and the like are not limited to the embodiments of the present invention or corresponding embodiments. Moreover, the devices in the figures are only used to express their corresponding positions and are not drawing according to their actual proportion.

Figure 1:
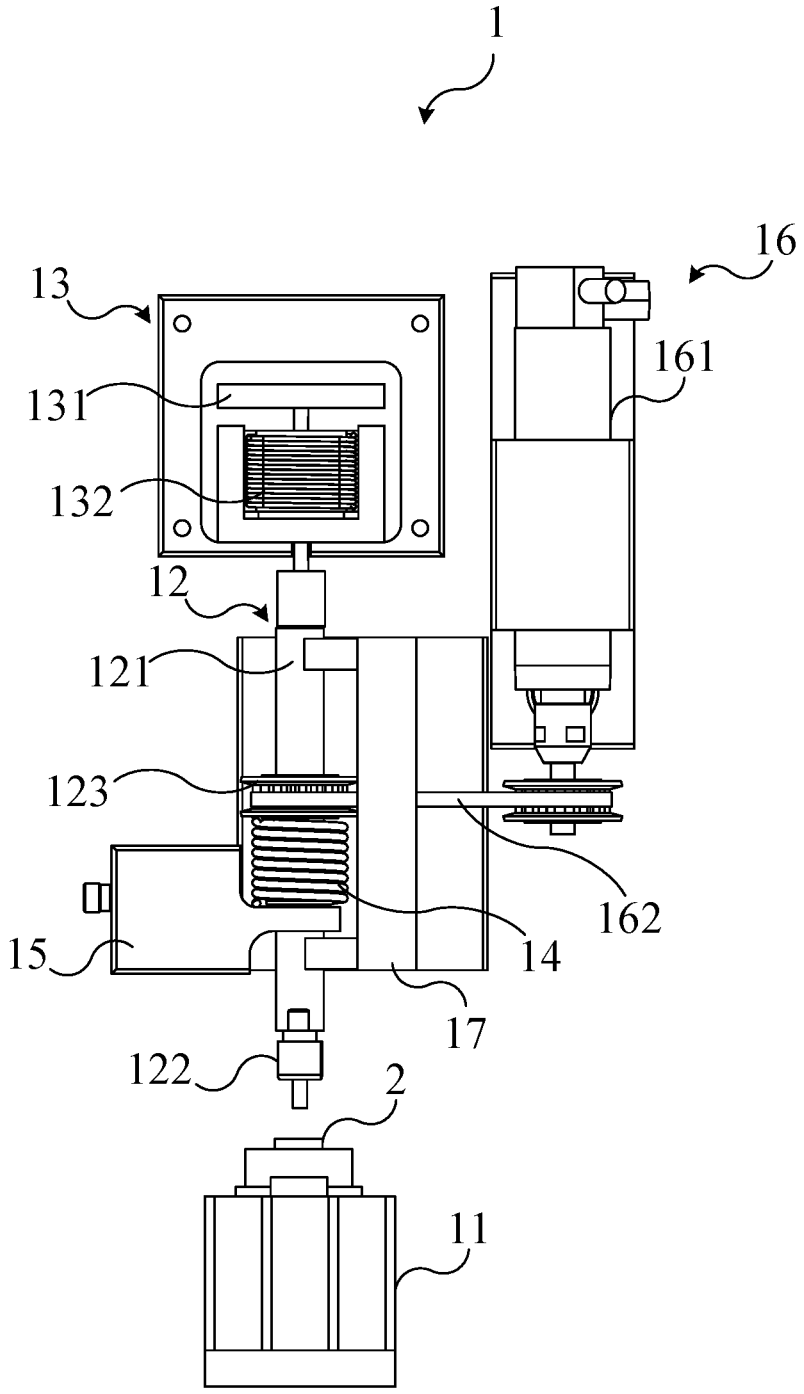
FIG. 1 is a schematic diagram illustrating an electromagnetic stamping apparatus in an embodiment of the present invention.

Please refer to FIG. 1. FIG. 1 is a schematic diagram illustrating an electromagnetic stamping apparatus 1 in an embodiment of the present invention. In this embodiment, the electromagnetic stamping apparatus 1 includes a work platform 11, a stamping component 12 and an electromagnetic device 13. The work platform 11 is configured to load a work piece 2. The stamping component 12 is configured relative to the work platform 12. The stamping component 12 includes a stamping rod 121 and a stamping head 122. The stamping head 122 is configured at one end of the stamping rod 121 and configured to stamp the work piece 2. The electromagnetic device 13 generates the magnetic force according to the alternating current to push the stamping component 12 to make the stamping component 12 stamp the work piece 2.

In practice, the work piece 2 can be configured on the surface of one side of the work platform 12. The stamping component 12 is configured above the work platform 12 and at the same side of the work piece 2. The stamping head 122 located at one end of the stamping rod 121 faces to the work piece 2. The electromagnetic device 13 is configured at the other one end of stamping rod 121 opposite to the stamping head 122. Therefore, the order of the components of the electromagnetic stamping apparatus 1 is the work platform 12, the work piece 2, the stamping head 122, the stamping rod 121 and the electromagnetic device 13. The electromagnetic device 13 generates the magnetic force to push the stamping rod 121 and drive the stamping head 122 to make the stamping component 12 stamp the work piece 2 when the electromagnetic device 13 receives an alternating current.

Figure 2:
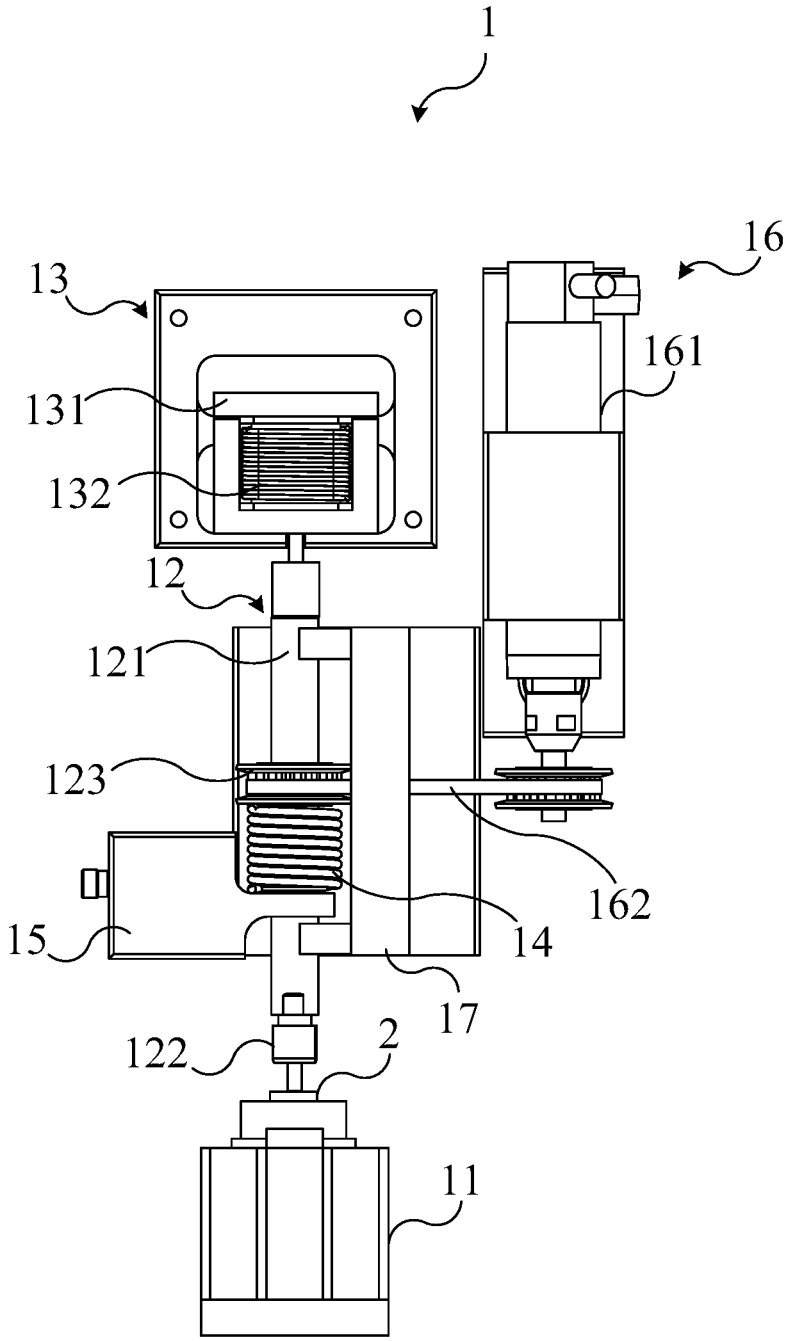
FIG. 2 is a schematic diagram illustrating the stamping component of the electromagnetic stamping apparatus of FIG. 1 at the first position.

Please refer to FIG. 1 and FIG. 2. FIG. 2 is a schematic diagram illustrating the stamping component 12 of the electromagnetic stamping apparatus 1 of FIG. 1 at the first position. In this embodiment, the stamping component 12 of the electromagnetic stamping apparatus 1 has a first position and a second position, and the stamping component 12 stamps the work piece 2 at the first position. In practice, the first position is the position which the stamping head 122 of the stamping component 12 contacts and stamps the work piece 2, and the second position is the position which the stamping head 122 of the stamping component 12 separates from the surface of the work piece 2 and has a distance with the work piece 2. When the electromagnetic device 13 generates the magnetic force after receiving the alternating current, the electromagnetic device 13 pushes the stamping component to the first position by the magnetic force to make the stamping component stamp the work piece 2.

As shown in FIG. 1, the electromagnetic device 13 further includes an electromagnetic component 131 and an electromagnetic coil 132. The electromagnetic component 131 is coupled to the stamping rod 121 of the stamping component 12 and magnetically coupled to the electromagnetic coil 132. The electromagnetic coil 132 generates the magnetic force according to the alternating current applied on the electromagnetic coil 132 to attract the electromagnetic component 131, so that the electromagnetic component 131 pushes the stamping component 12 to the first position. In practice, the material of the electromagnetic component 131 can be magnetic material (such as iron, steel, nickel), and the material of the electromagnetic coil 132 can be copper. The stamping rod 121 of the stamping component 12 can contact the electromagnetic component 131. Moreover, the stamping rod 121 can pass through the electromagnetic coil 132 to contact the electromagnetic component 131. The electromagnetic coil 132 can be fixed on the substrate (not shown in the figures) of the electromagnetic stamping apparatus 1, and the electromagnetic component 131 is configured at the other side of the electromagnetic coil 132 opposite to the stamping head 122 and can move relative to the electromagnetic coil 132. The electromagnetic coil 132 generates the magnetic force when the alternating current is applied on the electromagnetic coil 132. At this time, the electromagnetic component 131 is attracted by the magnetic force generated by the electromagnetic coil 132 and moves toward the electromagnetic coil 132. Since the stamping rod 121 of the stamping component 12 contacts the electromagnetic component 131, the electromagnetic component 131 also pushes the stamping rod 121 and drives the stamping component 12 to the first position at the same time when the electromagnetic component 131 is attracted by the magnetic force and moves toward the electromagnetic coil 132. It should be noted that the materials of the electromagnetic component 131 and the electromagnetic coil 132 are not limited thereto.

In one embodiment, the electromagnetic component 131 can include an electromagnetic fixed component (not shown in figure) fixed on the substrate, and the electromagnetic coil 132 winds around the outer surface of the electromagnetic fixed component. When the alternating current is applied on the electromagnetic coil 132, the electromagnetic fixed component generates the magnetic force due to the induction by the electromagnetic coil 132 and attracts the electromagnetic component 131 by the magnetic force to make the stamping component 12 stamp the work piece 2. In this embodiment, the motions and functions of the electromagnetic component 131 and the electromagnetic coil 132 are the same with those of the electromagnetic component 131 and the electromagnetic coil 132 in the aforementioned embodiment, and it will not described thereto.

As shown in FIG. 2, the electromagnetic stamping apparatus 1 further includes a compression spring 14 and a limit block 15, and the stamping component 12 further includes a block 123. The compression spring 14 and the limit block 15 are coupled to the stamping component 12, and the block 123 is coupled to the stamping rod 121. The compression spring 14 is configured between the limit block 15 and the block 123, and two ends of the compression spring 14 respectively contact the limit block 15 and the block 123. The compression spring 14 pushes the block 123 by the restoring force of the compression 14 to move the stamping component 12 to the second position. In practice, the compression spring 14 can be configured around the stamping rod 121 of the stamping component 12, and the inner diameter of the compression spring 14 is greater than the diameter of the stamping rod 121. The limit block 15 can be set around the stamping rod 121 of the stamping component 12. The block 123 can be fixed on the stamping rod 121 and move with the stamping component 12. In this embodiment, the compression spring 14 is disposed at the other side of the limit block 15 opposite to the stamping head 122, and one end of the compression spring 14 contacts the limit block 15. The block 123 is disposed on the other side of the compression spring 14 opposite to the limit block 15, and the other one end of the compression spring 14 contacts the block 123. Therefore, the compression spring 14 can contact the limit block 15 and push the block 123 by the restoring force of the compression spring 14, so as to drive the stamping component 12 to move to the second position.

Figure 3:
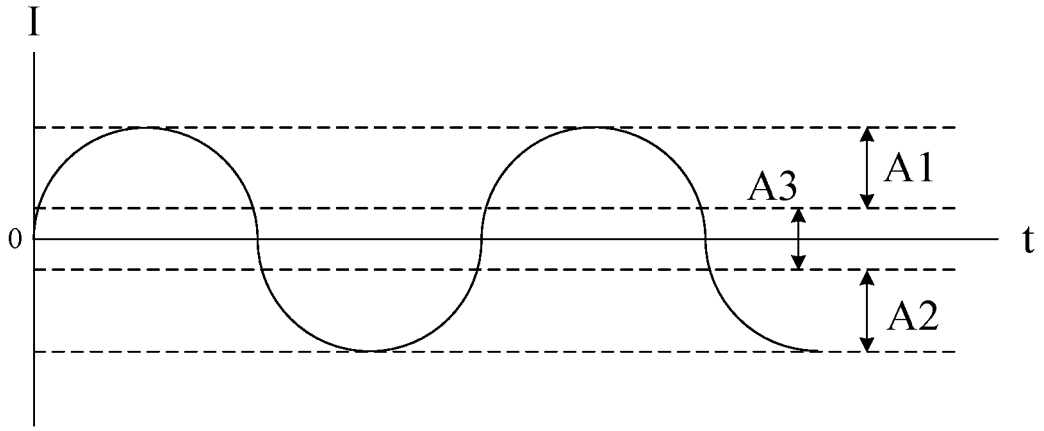
FIG. 3 is a schematic diagram illustrating the alternating current in the embodiment of FIG. 1.

Please refer to FIG. 1, FIG. 2 and FIG. 3. FIG. 3 is a schematic diagram illustrating the alternating current in the embodiment of FIG. 1. As shown in FIG. 3, the aforementioned alternating current includes a plurality of waveforms. Every waveform period includes a first peak value area A1, a second peak value area A2 and a base value area A3 between the first peak value area A1 and the second peak value area A2. The electromagnetic device 13 respectively generates a first magnetic force and a second magnetic force according to the first peak value area A1 and the second peak value area A2 to push the stamping component 12 to the first position, and the stamping component 12 is pushed to the second position by the compression spring 14 during the base value area A3. In practice, the waveform of the alternating current can be a sine wave, but it is not limited thereto. The horizontal axis t is time and the vertical axis I is current value in FIG. 3. The absolute values of the values in the first peak value area A1 and the second value area A2 are greater than those in the base value area A3. During the waveform of the alternating current located at the first peak value area A1 and the second peak value area A2, the first magnetic force and the second magnetic force generated by the electromagnetic device 13 are greater than the restoring force of the compression spring 14. Therefore, the electromagnetic component 131 of the electromagnetic device 13 is respectively attracted by the first magnetic force and the second magnetic force to move toward the electromagnetic coil 132 and pushes the stamping component 12 to the first position to make the stamping component 12 stamp the work piece 2. During the waveform of the alternating current located at the base value area A3, the magnetic force generated by the electromagnetic device 13 is smaller than the restoring force of the compression spring 14. Therefore, one end of the compression spring 14 contacts the limit block 15 and the other end of the compression spring 14 pushes the block 123 away from the work piece 2 to the second position.

Since the sequence in each waveform period of the alternating current is arranged as the base value area A3, the first peak value area A1, the base value area A3, the second peak value area A2, and then the base value area A3, the magnetic force generated by the electromagnetic device 13 will be greater than the restoring force of the compression spring 14 twice in each waveform period of the alternating current. Furthermore, the stamping rod 121 is pushed to the first position twice by the electromagnetic component 131 in every waveform period of the alternating current. In other words, the stamping component 12 stamps the work piece 2 twice in every waveform period of the alternating current to improve the production efficiency.

Figure 4:
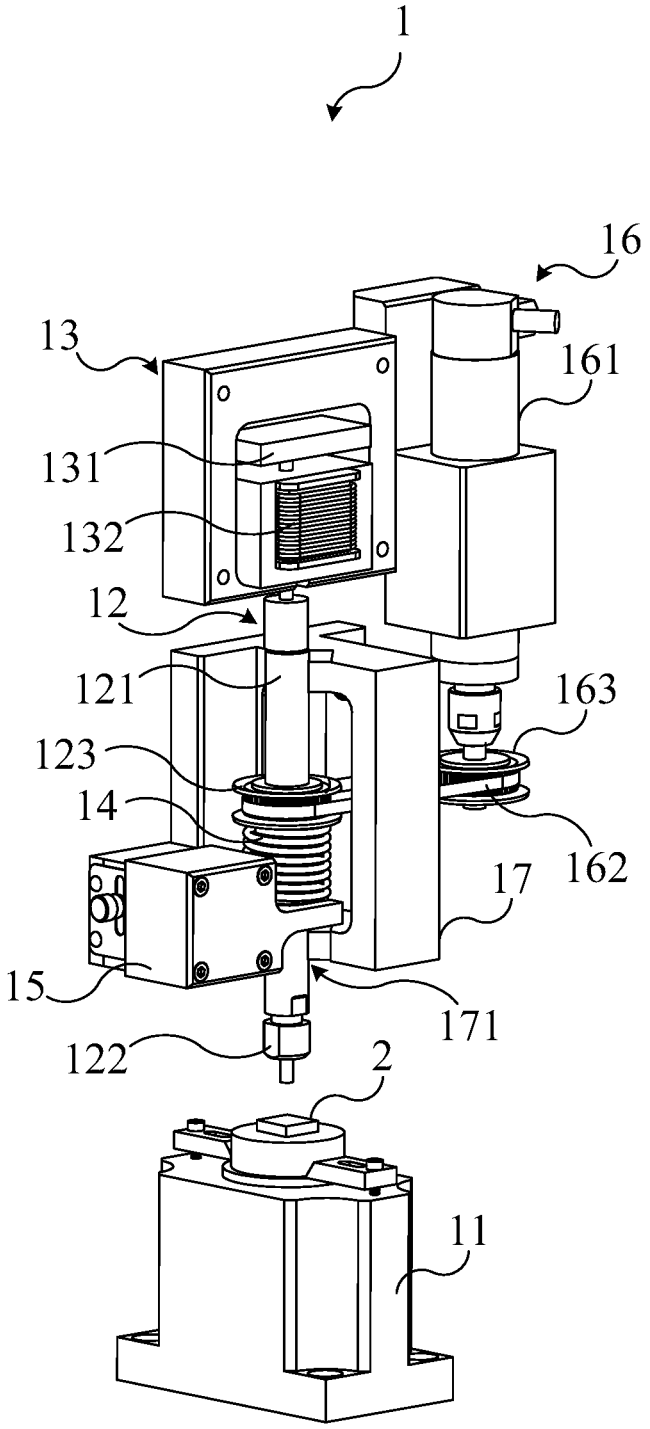
FIG. 4 is an exploded diagram illustrating the electromagnetic stamping apparatus of FIG. 2 in another one perspective.

Please refer to FIG. 2 and FIG. 4. FIG. 4 is an exploded diagram illustrating the electromagnetic stamping apparatus 1 of FIG. 2 in another perspective. In this embodiment, the electromagnetic stamping apparatus 1 further includes a rotating component 16 and a limit component 17. The rotating component 16 includes a motor 161 and a timing belt 162. The timing belt 162 is coupled to the stamping rod 121 and the motor 161, and the motor 161 drives the stamping component 12 to rotate at a rotating speed. The limit component 17 includes a limit groove 171. The limit groove 171 is coupled to the stamping component 12 and configured to limit the motion direction of the stamping component 12. In practice, the motor 161 can be configured on the substrate, and the rotating component 16 can include a rotating member 163 connected to the motor 161. The timing belt 162 can be connected to the rotating member 163 and the block 123 of the stamping component 12. Therefore, when the motor 161 operates at the rotating speed, it drives the rotating member 163 to rotate and the rotating member 163 drives the block 123 to rotate through the timing belt 162, so as to drive the stamping component 12 to rotate. In one embodiment, the rotating member 163 and the block 123 are the timing wheel. The limit component 17 can be configured on the substrate and contact one side of the stamping rod 121 of the stamping component 12. Moreover, the rotating member 163 of the rotating component 16 can control the block 123 to move toward the limit component 17 by the tensile force of the timing belt 162, so as to make the stamping component 12 contact the limit groove 171 of the limit component 17. Therefore, the limit component 17 can ensure that the stamping component 12 stamps the work piece 2 at the same position, thereby improving the precision of the products.

Figure 5:
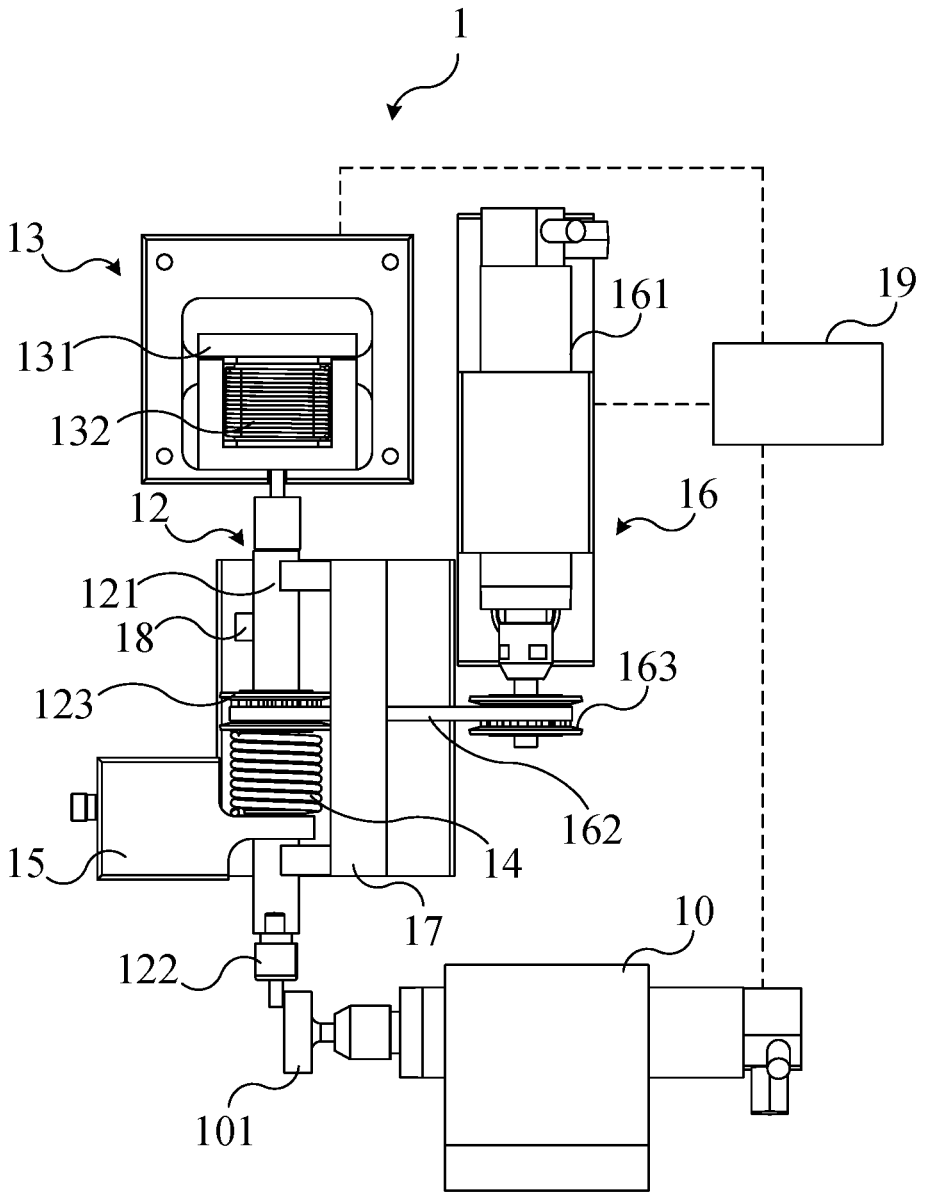
FIG. 5 is a schematic diagram illustrating the electromagnetic stamping apparatus in one embodiment of the present invention.

Please refer to FIG. 5. FIG. 5 is a schematic diagram illustrating the electromagnetic stamping apparatus 1 in one embodiment of the present invention. In this embodiment, the electromagnetic stamping apparatus 1 further includes a sensor 18, a controller 19 and a grinding mechanism 10. The sensor 18 is coupled to the stamping component 12. The controller 19 is connected to the sensor 18, the motor 16 and the grinding mechanism 10. The grinding mechanism 10 movably contacts the stamping component 12 and includes a grinding wheel 101. The sensor 18 is configured for sensing the motion state of the stamping component 12 and generates a sensing value. The controller 19 controls the motor 161 and the grinding mechanism 10 according to the sensing value to control the grinding wheel 101 to contact and grind the stamping head 122 of the stamping component 12. In practice, the sensor 18 can be an impedance sensor and configured on the stamping rod 121 of the stamping component 12. The controller 19 can be a computer. The sensor 18 can sense the impedance value between the stamping head 122 and the work piece 2 while the stamping component 12 contacts the work piece 2. When the stamping head 122 is stuck since it stamps the work piece 2 for a long time, the impedance value sensed by the sensor is increased. When the controller 19 detects that the impedance value is greater than the impedance threshold value, it turns on the motor 161 to make the stamping component 12 rotate and controls the grinding mechanism 10 to move to control the grinding wheel 101 to contact and grind the stamping head 122 of the stamping component 12. Therefore, the stamping head 122 can be online grinded without removing it from the stamping component 12 to reduce costs.

Figure 6:
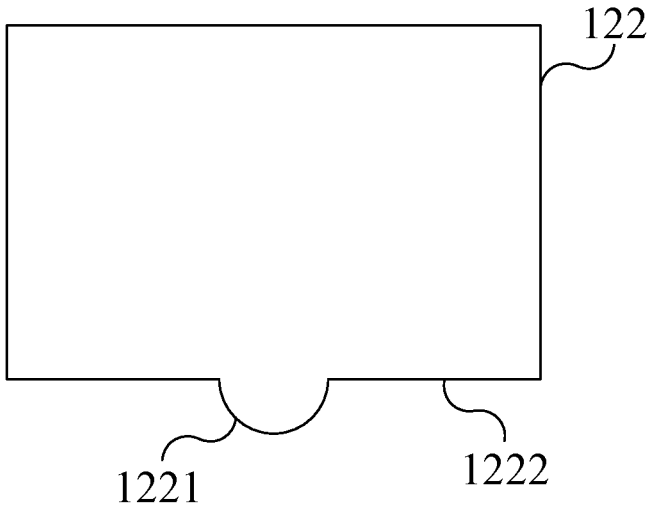
FIG. 6 is a schematic diagram illustrating the stamping head in one embodiment of the present invention.

Please refer to FIG. 6. FIG. 6 is a schematic diagram illustrating the stamping head 122 in an embodiment of the present invention. As shown in FIG. 6, the stamping head 122 has a stamping portion 1221 and a flat portion 1222 on the outer edge of the stamping portion 1221. When the stamping head 122 stamps the work piece 2, the stamping portion 1221 stamps the work piece 2 and the flat portion 1222 contacts the surface of the work piece 2. In practice, the stamping portion 1221 can protrude from the flat portion 1222, and the area of the flat portion 1222 is greater than that of the stamping portion 1221. When the stamping component 12 stamps the work piece 2, in addition to the stamping portion 1221 stamps on the work piece 2, the flat portion 1222 contacts the surface of the work piece 2 at the same time. Therefore, the flat portion 1222 can remove burrs or flashes on the work piece 2 at the outer edge of the stamping portion 1221, thereby improving the quality of products. It should be noted that the shape of the stamping portion 1221 of the stamping head 122 is not limited to the arc shape in FIG. 6, but can be designed according to requirements.

In another embodiment, the stamping portion also can be dent in the flat portion. In this embodiment, the work piece includes a bulging structure extended from the surface of the work piece. The stamping portion of the stamping head stamps the bulging structure of the work piece, and the flat portion of the stamping head contacts the surface of the work piece. In practice, when the stamping head stamps the work piece, the stamping portion dented in the flat portion stamps the bulging structure of the work piece, and the excessive work piece material is squeezed onto the surface of the work piece. The flat portion disperses and flattens the excessive work piece material by contacting the surface of the work piece to remove the burrs or flashes located on the work piece at the outer edge of the stamping portion, thereby improving the quality of products.

In summary, the electromagnetic stamping apparatus of the present invention can make the stamping component stamp the work piece twice in every waveform period of the alternating current by the electromagnetic device and the compression spring, and control the stamping direction of the stamping component by the rotating component and the limit component. Moreover, the electromagnetic stamping apparatus also can online grind the stamping head to improve the production efficiency and reduce the production costs.

With the examples and explanations mentioned above, the features and spirits of the invention are hopefully well described. More importantly, the present invention is not limited to the embodiment described herein. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An electromagnetic stamping apparatus, comprising:

a work platform configured to load a work piece;

a stamping component configured relative to the work platform, the stamping component being configured to move to a first position and a second position, and comprising a stamping rod, a stamping head and a block, the stamping head being configured at one end of the stamping rod and configured for stamping the work piece at the first position, and the block being fixed on the stamping rod;

an electromagnetic device coupled to the stamping rod of the stamping component, the electromagnetic device generating a magnetic force according to an alternating current to push the stamping component to the first position to make the stamping component stamp the work piece;

a compression spring coupled to the stamping component, the compression spring pushing the stamping component to the second position by the restoring force of the compression spring; and a rotating component comprising a motor and a timing belt, the timing belt being connected to the block and the motor, the motor being configured to drive the block to rotate through the timing belt to drive the stamping component to rotate at a rotational speed;

wherein, the magnetic force is greater than the restoring force of the compression spring to make the stamping component stamp the work piece twice in every waveform period of the alternating current.

2. The electromagnetic stamping apparatus of claim 1, wherein every waveform period of the alternating current comprises a first peak value area, a second peak value area, and a base value area between the first peak value area and the second peak value area, the electromagnetic device respectively generates a first magnetic force and a second magnetic force according to the first peak value area and the second peak value area to push the stamping component to the first position, the stamping component is pushed to the second position by the compression spring in the base value area.

3. The apparatus of claim 2, wherein the waveform of the alternating current is a sine wave.

4. The apparatus of claim 1, wherein the electromagnetic device further comprises an electromagnetic component and an electromagnetic coil, the electromagnetic component is coupled to the stamping rod of the stamping component and magnetically coupled to the electromagnetic coil, the electromagnetic coil generates the magnetic force according to the alternating current applied to the electromagnetic coil to attract the electromagnetic component to make the electromagnetic component push the stamping component to the first position.

5. The apparatus of claim 1, further comprising a limit block coupled to the stamping component, the compression spring being configured between the limit block and the block, and two ends of the compression spring respectively contacting the limit block and the block, the compression spring pushing the block according to the restoring force to push the stamping component to the second position.

6. The apparatus of claim 1, further comprising a limit component, and the limit component comprising a limit groove, the limit groove being coupled to the stamping component and configured to limit the motion direction of the stamping component, the stamping rod contacting the limit groove by the tensile force of the timing belt.

7. The apparatus of claim 1, further comprising a sensor and a controller, the sensor being coupled to the stamping component and the controller being connected to the sensor and the motor, the sensor being configured for sensing the motion state of the stamping component and generating a sensing value, the controller controlling the motor to rotate at the rotational speed according to the sensing value.

8. The apparatus of claim 7, further comprising a grinding mechanism movably contacted the stamping component, the grinding mechanism comprising a grinding wheel and the controller being connected to the grinding mechanism, the controller controlling the grinding mechanism to make the grinding wheel of the grinding mechanism contact and grind the stamping head of the stamping component when the stamping component rotates at the rotational speed.

9. The apparatus of claim 1, wherein the stamping head comprises a stamping portion and a flat portion on the outer edge of the stamping portion, the stamping portion stamps the work piece and the flat portion contacts the surface of the work piece when the stamping head stamps the work piece.

* * * * *